United States Patent [19]

Mueller et al.

[11] 4,101,267

[45] Jul. 18, 1978

[54] ROLL FUSER CLEANING SYSTEM

[75] Inventors: Karl J. Mueller, Fairport; Dewey H. Haumann, Jr., Palmyra; Alvin D. Kromm, Jr., Webster, all of N.Y.

[73] Assignee: Xerox Corporation, Stamford, Conn.

[21] Appl. No.: 621,991

[22] Filed: Oct. 14, 1975

[51] Int. Cl.[2] ..... F27B 9/28

[52] U.S. Cl. ..... 432/60; 118/70; 118/101; 118/104

[58] Field of Search ..... 118/60, 70, 203, 104, 118/101, DIG. 2; 432/8, 59, 60, 227, 228

[56] References Cited

U.S. PATENT DOCUMENTS

| | | | |
|---|---|---|---|
| 687,481 | 11/1901 | Kammerer et al. | 118/70 |
| 2,363,817 | 11/1944 | Taylor | 118/203 X |
| 3,796,183 | 3/1974 | Thettu | 432/60 X |
| 3,883,291 | 5/1975 | Cloutier et al. | 118/203 X |
| 3,912,901 | 10/1975 | Strella et al. | 432/228 X |

FOREIGN PATENT DOCUMENTS

| | | | |
|---|---|---|---|
| 829,335 | 1/1952 | Fed. Rep. of Germany | 118/DIG. 2 |

*Primary Examiner*—Dorsey Newton

[57] ABSTRACT

Fuser apparatus for utilization in a xerographic reproducing apparatus for fixing toner images adhered to substrates wherein the fuser apparatus comprises a heated fuser roll and a backup roll cooperating therewith to form a nip through which the substrates pass with the toner images contacting the heated fuser roll. A non-contact silicone oil applicator is provided together with a metering blade for applying a uniformly thick coating on the surface of the fuser roll which coating serves to minimize effect of toner.

12 Claims, 1 Drawing Figure

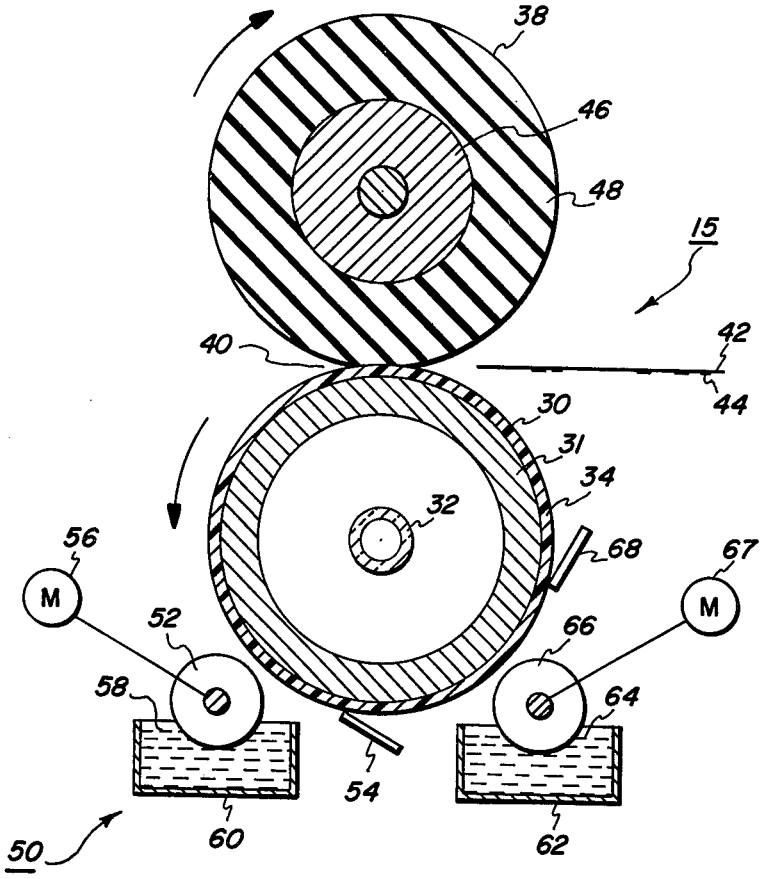
38
46
48
15
42
40
44
30
31
34
32
68
56
67
M
M
52
66
58
64
54
50
60
62

ROLL FUSER CLEANING SYSTEM

BACKGROUND OF THE INVENTION

This invention relates generally to xerographic copying apparatus and, more particularly, to a contact fusing system and cleaning mechanism therefor for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, the use of thermal energy for fixing toner images onto a support member is old and known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the heated roll to thereby effect heating of the toner images within the nip.

By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner would liquefy and cause a splitting action in the molten toner to thereby result in "hot offset". Splitting occurs when the cohesive forces holding the viscous toner mass together are less than the adhesive forces tending to offset it to a contacting surface such as a fuser roll.

The foregoing notwithstanding, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the problems attendant the foregoing, particularly that which is commonly referred to as "offsetting" has been to provide a fuser roll with an outer surface or covering of polytetrafluoroethylene, commonly known as Teflon, to which a release agent such as silicone oil is applied, the thickness of the Teflon being on the order of 0.9 to 1.4 mils and the thickness of the oil being less than 1 micron. Silicone based oils, which possess a relatively low surface energy, have been found to be materials that are suitable for use in the heated fuser roll environment where Teflon constitutes the outer surface of the fuser roll. In practice, a thin layer of silicone oil is applied to the surface of the heated roll to thereby form an interface between the roll surface and the toner images carried on the support material. Thus, a low surface energy layer is presented to the toner as it passes through the fuser nip and thereby prevents toner from offsetting to the fuser roll surface. The foregoing notwithstanding, "non-visual offsetting" (i.e. offsetting of very fine particles of toner) does occur. In prior art constructions (fuser structures where the outer surface comprises Teflon) such offsetting has been combated by the employment of various cleaning members, the wick material employed for applying the silicone based oil to the fuser roll serving this purpose.

Continued contamination of a wick applicator in the foregoing manner is undesirable.

Accordingly, the primary object of this invention is to provide a new and improved contact fuser system for affixing toner images to substrates.

A more particular object of this invention is to provide an improved release agent applicator for heated fuser rolls.

Another object of this invention is to provide, in a contact fuser system employing a fuser roll structure, a release agent applicator comprising a roll adapted to apply a coating of release agent material to the fuser without contacting the fuser roll. A metering blade is subsequently employed for metering the release agent material to the desired thickness.

BRIEF SUMMARY OF THE INVENTION

Briefly, the above-cited objects are accomplished by the provision, in a xerographic copier or reproducing apparatus, a contact fuser comprising a heated fuser roll and a backup roll forming a nip therebetween through which substrates or support material carrying toner images pass with the toner images contacting the heated fuser member to thereby become softened. Subsequent cooling of the toner renders the images permanently fixed to the substrate.

The fuser apparatus is characterized by the provision of a system for cleaning toner and other contaminants from the surface of the fuser roll wherein a roll which is spaced from the fuser roll to thereby prevent contact therebetween is rotated through a sump of silicone oil release material with subsequent application of a liberal amount of silicone oil to the surface of the fuser roll. A doctor blade is provided which contacts the surface of the fuser roll to thereby remove substantially all of the silicone oil applied to the roll along with any contaminants which appear on the fuser roll.

After the cleaning of the roll in the foregoing manner, a second release agent or material applicator applied release material to the surface of the fuser roll without contacting said roll and the release material is subsequently smoothed to a desired thickness by means of a metering blade.

Other objects and advantages of the present invention will become apparent when read in conjunction with the accompanying drawings.

DETAILED DESCRIPTION OF THE DRAWINGS

The FIGURE is a schematic representation of a roll fuser for fixing toner images to substrate material.

DETAILED DESCRIPTION OF THE PREFERRED EMBODIMENT

Since the xerographic reproducing process is well known, a detailed description thereof is omitted. For those who whould consider the description of the xerographic process necessary for a complete understanding of the present invention reference may be had to U.S. Pat. Nos. 3,718,116 and 3,745,972 both of which are incorported herein by reference.

As shown in FIG. 1, the present invention comprises a fuser roll assembly 15 including a heated roll structure 30 including a hollow cylinder or core 31 having a suitable heating element 32 disposed in the hollow portion thereof and which is coextensive with the longitudinal axis of said cylinder or core. A core 31 has provided on the outer surface thereof a layer of Teflon 34 or other suitable material which has abhesive characteristics, therefore, tendency to release toner type contaminants therefrom. The heating element 32 may comprise a suitable type heater for elevating the surface of the Teflon layer to operational temperatures, therefore, temperatures on the order of 250° to 450° F. For example, the heating element may comprise a quartz lamp. The cylinder or core 31 is fabricated from any thermally conductive material, for example, copper, aluminum or alloys thereof. The resulting structure has an outside diameter on the order of 1.5 to 3.0 inches and a length on the order of 10 to 15 inches.

Power requirements for the foregoing are 500–2500 watts, peak power with an average power 300–2000 watts and 75–250 watts for standby.

The surface temperature of the fuser roll structure may be controlled by contacting the surface thereof with a thermistor probe (not shown) in a manner described in U.S. Pat. No. 3,327,096, issued in 1967 to Bernous and incorporated herein by reference. To this end, the end of the roll contacted by the thermistor probe may be specifically designed to accommodate such control of the operating temperature. In other words, means may be provided to reduce friction between the probe and the surface of the fuser roll structure. One method of accomplishing the foregoing would be to manufacture the fuser roll structure 30 such that the end thereof is devoid of Teflon material in the area contacted by the probe and the set point of thermistor is adjusted accordingly.

The fuser assembly 15 further comprising a backup roll structure 38 which cooperates with the fuser roll structure to form a nip 40 through which copy paper or substrate material 42 passes such that toner images 44 thereon contact the surface of the fuser roll structure 30. Backup roll structure 38 may comprise any suitable construction, for example, a steel cylinder, preferably comprising a rigid steel core 46 having a Viton elastomer layer or surface 48 which, as can be observed, has a relatively large thickness in order to provide a soft member which can be indented by the fuser roll structure 30 in order to form the nip 40.

After the copy sheet or substrate material 42 passes through the nip 40 it tends to stick or adhere to the surface of the fuser roll structure 30. Accordingly, a stripper finger structure (not shown) may be provided for stripping the copy paper or substrate material from the surface of the fuser roll structure 30 so that the copy sheets can continue on their path of movement toward the exit of the copier apparatus.

As noted hereinabove, as the copy sheets 42 pass through the nip 40 and in contact with the surface of the fuser roll structure 30 contaminants are offset to the surface of the fuser roll structure 30.

A system for cleaning or removing contaminants such as toner from the surface of the fuser roll is generally indicated by reference character 50. The cleaning system comprises a roll 52 supported for rotation contiguous the fuser roll 30 and a doctor blade cleaning member 54 supported for scraping contact of the fuser roll 30. The roll 52 is supported for rotation by means comprising a motor 56 such that it rotates through a quantity of silicone oil 58 contained in a sump 60. The oil preferably has a viscosity of approximately 250 cs and the roll 52 is spaced from the fuser roll 30 such that a gap of 0.020 inches is provided. The roller 52 is adapted to be rotated at a surface speed of 3.8 inches per second when the fuser roll is rotated at 20 inches per second to thereby apply a coating of silicone oil to the surface of the fuser roll in a thickness of approximately 3 mils. The roll 52 is preferably fabricated from a metal, for example, steel. While the system 50 is as described above, other cleaning systems may be employed, for example, a roll or rolls covered with a tacky material such as toner may be utilized.

The doctor blade 54 which is preferably fabricated from a high durometer silicone rubber, for example a 90 shore A durometer, scrapes the surface of the fuser roll 30 to thereby substantially remove all of the oil applied by the roll 52 and along with the oil removes contaminants such as paper fiber and toner particles.

A second sump 62 containing a quantity of silicone oil 64 is provided along with a second applicator roll 66 which is adapted to be rotated through the silicone oil 64 and to coat the fuser surface with a coating of silicone oil in a thickness substantially less than that applied by the roller 52. To this end, the roll 66 is adapted to apply less than a one mil thickness of silicone oil to the fuser roll surface. This can be accomplished in any number of ways, for example, by increasing the spacing between the fuser roll 30 and the roller applicator 66 over that of the spacing between the roller 52 and the fuser roll. Alternatively, the viscosity of the silicone oil 64 could be varied as well as modifying the speed of rotation of the roll 66 relative to that of the fuser roll 30, such variation in speed being accomplished by means of a motor 67.

A metering blade 68 is provided for metering the oil on the surface of the fuser roll to a thickness of approximately 30 micro inches. The accomplishment of such metering is well known to those skilled in the art and may be accomplished in accordance with well known practices, therefore, a description thereof is omitted.

While the invention has been disclosed in accordance with the preferred embodiment it will be appreciated that modifications thereto without departure from the spirit and scope of the invention are possible and it is intended that such modifications be covered by the claims appended hereto.

What is claimed is:

1. Roll fuser apparatus including a heated fuser roll cooperating with a resilient backup roll for forming a nip through which support material having toner images adhered thereto moves with said toner images contacting said heated fuser roll to thereby soften the toner forming said toner images, said apparatus comprising:

a first means containing a quantity of first release fluid;

an applicator member, said applicator member being spaced from said heated fuser roll whereby there is no contact between the surfaces of said cleaning member and said heated fuser roll;

means for effecting movement of said applicator member through said first release fluid, said movement being effective to coat the surface of said applicator member to a thickness sufficient to transfer release fluid from said applicator member to said heated fuser roll;

a doctor blade cleaning member engaging the surface of said heated fuser roll for removing substantially all the release fluid from the heated fuser roll and any contaminants deposited thereon;

second means containing a quantity of second release fluid;

means for applying a coat of said second release fluid to said heated fuser roll subsequent to the functioning of said cleaning member, said second release fluid applying means serving to apply said release fluid in a thickness substantially less than the thickness initially applied for cleaning of said heated fuser roll whereby said last mentioned coating enhances release of support material from said heated fuser roll.

2. Apparatus according to claim 1 wherein the spacing between said applicator member and said heated fuser roll; speed of rotation of said member and roll; the viscosity of said release fluid and the surface characteristics of said roll and said member are such as to effect the application of said release fluid in a thickness of approximately 3 mils.

3. Apparatus according to claim 2 wherein said applicator member comprises a roll configuration.

4. Apparatus according to claim 3 wherein said release fluid comprises silicone oil having a viscosity of approximately 250 cs.

5. Apparatus according to claim 4 wherein said roll has a surface speed of 3.8 inches per second when the surface speed of said heated fuser roll is 20 inches per second.

6. Apparatus according to claim 5 wherein the spacer between said heated fuser roll and said applicator member is 0.020 inches.

7. Apparatus according to claim 6 wherein the durometer of said blade is 90 shore A.

8. Apparatus according to claim 7 wherein said first and second means containing said release fluid each comprises a sump.

9. Apparatus according to claim 8 wherein the thickness of said last-mentioned coating is approximately 30 micron inches.

10. Apparatus according to claim 9 wherein said means for applying said second coating of release material comprises a roll rotatable through silicone oil in said second sump and a metering blade.

11. Apparatus according to claim 10 wherein said roll applies silicone oil to said heated fuser roll and a thickness which is less than a mil.

12. Apparatus according to claim 11 wherein the rolls for applying release fluid to said fuser roll are fabricated from metal.

* * * * *

UNITED STATES PATENT AND TRADEMARK OFFICE

CERTIFICATE OF CORRECTION

PATENT NO. : 4,101,267

DATED : July 18, 1978

INVENTOR(S) : Karl J. Mueller, Dewey H. Haumann, Jr.
Alvin D. Kromm, Jr.

It is certified that error appears in the above-identified patent and that said Letters Patent are hereby corrected as shown below:

Please make following correction on title page of

Patent No. 4,101,267:

Dewey H. Haumann, Jr. should be changed
to Dewey H. Hauman, Jr.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*